US008919629B2

(12) United States Patent
Moreau et al.

(10) Patent No.: US 8,919,629 B2
(45) Date of Patent: Dec. 30, 2014

(54) TOOL BELT MOUNTABLE DEVICE FOR RETRACTABLE TOOL LANYARDS

(76) Inventors: Darrell A. Moreau, Manchester, NH (US); Andre W. Moreau, Spring Hill, FL (US)

( * ) Notice: Subject to any disclaimer, the term of this patent is extended or adjusted under 35 U.S.C. 154(b) by 880 days.

(21) Appl. No.: 12/536,016

(22) Filed: Aug. 5, 2009

(65) Prior Publication Data

US 2010/0032465 A1 Feb. 11, 2010

Related U.S. Application Data

(60) Provisional application No. 61/087,205, filed on Aug. 8, 2008.

(51) Int. Cl.

| | |
|---|---|
| ***A45C 1/04*** | (2006.01) |
| ***A45F 3/00*** | (2006.01) |
| ***F41C 33/02*** | (2006.01) |
| ***F42B 39/02*** | (2006.01) |
| ***B65D 69/00*** | (2006.01) |
| ***B65D 71/00*** | (2006.01) |
| ***A45C 11/00*** | (2006.01) |
| ***A45C 11/32*** | (2006.01) |
| ***A45C 15/00*** | (2006.01) |
| ***A44B 6/00*** | (2006.01) |
| ***A45F 5/00*** | (2006.01) |
| ***A41D 5/00*** | (2006.01) |
| ***A45F 5/02*** | (2006.01) |

(52) U.S. Cl.

CPC . *A45F 5/02* (2013.01); *A45F 5/004* (2013.01); *A45F 5/021* (2013.01); *A45F 2005/006* (2013.01); *A45F 2200/0575* (2013.01)

USPC ..... 224/674; 224/242; 224/254; 224/269; 224/666; 224/667; 224/668; 224/676; 224/680; 224/683; 206/234; 206/37.1; 206/37; 206/38.1; 206/38; 24/3.13; 2/66

(58) Field of Classification Search

CPC ..... A45F 5/02

USPC ..... 224/242, 254, 269, 666, 667, 668, 676, 224/680, 683; 206/234, 37.1, 37, 38.1, 38; 24/3.13; 2/66

See application file for complete search history.

(56) References Cited

U.S. PATENT DOCUMENTS

| | | | | | |
|---|---|---|---|---|---|
| 275,373 | A | * | 4/1883 | Farnsworth | 2/66 |
| 2,413,580 | A | * | 12/1946 | Perry | 206/3 |
| 2,835,896 | A | * | 5/1958 | Giese | 2/66 |
| 3,949,915 | A | * | 4/1976 | Burhans | 224/269 |
| 4,047,650 | A | * | 9/1977 | Domingos | 224/223 |
| 4,232,808 | A | * | 11/1980 | Gray | 224/610 |
| 4,796,790 | A | * | 1/1989 | Hamilton | 224/675 |
| 4,862,519 | A | * | 9/1989 | Bull | 2/66 |
| 5,139,187 | A | * | 8/1992 | Fowler | 224/576 |

(Continued)

*Primary Examiner* — Brian D Nash

*Assistant Examiner* — Derek Battisti

(74) *Attorney, Agent, or Firm* — Robert R. Deleault, Esq.; Mesmer & Deleault, PLLC

(57) ABSTRACT

A belt mountable tool lanyard device includes an enclosure having diametrically opposed first and second openings, a plurality of internal dividers within the enclosure forming a plurality of lanyard device chambers wherein each chamber has at least one chamber opening that faces in the same direction as one of the first and second openings and wherein at least one of the plurality of chambers has a second chamber opening diametrically opposed to the one chamber opening forming a belt receiving loop.

13 Claims, 4 Drawing Sheets

(56) References Cited

U.S. PATENT DOCUMENTS

| | | | | | |
|---|---|---|---|---|---|
| 5,244,023 | A * | 9/1993 | Spies | 150/134 |
| 5,499,401 | A * | 3/1996 | Heinmiller | 2/208 |
| 5,533,656 | A * | 7/1996 | Bonaldi | 224/667 |
| 5,961,018 | A * | 10/1999 | Abelbeck et al. | 224/584 |
| 5,964,386 | A * | 10/1999 | Cote | 224/250 |
| 6,126,054 | A * | 10/2000 | Riemer | 224/601 |
| 6,148,993 | A * | 11/2000 | Chisolm et al. | 206/38.1 |
| 6,273,245 | B1 * | 8/2001 | Mickelson | 206/37.1 |
| 6,321,958 | B1 * | 11/2001 | Erdmann | 224/236 |
| 6,345,752 | B1 * | 2/2002 | Chapman | 224/674 |
| 6,604,659 | B1 * | 8/2003 | Graves | 224/683 |
| 6,962,278 | B2 * | 11/2005 | Obatake | 224/681 |
| 2004/0099705 | A1 * | 5/2004 | Skupin | 224/674 |
| 2007/0205235 | A1 * | 9/2007 | Knight et al. | 224/223 |

* cited by examiner

TOOL BELT MOUNTABLE DEVICE FOR RETRACTABLE TOOL LANYARDS

This application claims the benefit of U.S. Provisional Patent Application No. 61/087,205, filed Aug. 8, 2008.

BACKGROUND OF THE INVENTION

1. Field of the Invention

The present invention relates generally to retractable tool lanyards. The present invention relates to a tool belt mountable device for retractable tool lanyards.

2. Description of the Prior Art

The use of hand tools (i.e. hammers, screw drivers, pliers, ratchets, levels, flashlights, tape measures, etc.) when working in overhead situations have the potential to be articles that can cause damage or injury. In these working conditions the hand tools if dropped could cause a hazard to personnel and/or equipment located beneath where the work is being performed.

There is a vast number of conventional tool belts that are used to carry hand tools. These types of tool belts when used in overhead situations will normally include a fastening feature that will lock the specific tool into the tool pouch when it is not being used. When the tool is needed to perform a specific task, however, the tool pouch is unfastened and the tool is removed from the tool pouch. While in use, if the tool is mishandled, bumped, or jarred, it can become dislodged from the user's hand and free to fall to whatever is beneath the worker. This normally does not pose a hazard except when there are personnel working or even passing by the area located beneath the worker's platform (i.e. when erecting scaffolding, working in elevated situations, etc.).

Another hazardous circumstance can arise when working above vital plant equipment. If a tool is dropped into an area where there is vital equipment, the dropped tool could cause severe damage to the equipment below. There have been many attempts to overcome these hazards with dropped tools. Makeshift lanyards using rope and/or string with duct tape as a fastening means have infamously been used to create wrist lanyards and tethers to keep a specific tool attached to the users arm or wrist.

More elaborate lanyards have also been manufactured for the prevention of dropped tools. One of the simpler models uses webbing with a hook and loop fastener so that it can be adjusted and tightened around the users wrist. With a D-ring sewn into the webbing, one end of a tether can be attached to the wrist lanyard and the other end attached to the tool using one of many available fasteners.

Even with the more elaborate tooling lanyards available on the market, there is still a high percentage of dropped tools occurring due to the inconvenience and cumbersome methods of detaching and reattaching different tools to the wrist lanyard in addition to the normal use of the tool.

Therefore, what is needed is tool belt mountable device that positions one or more retractable tool lanyards that can be easily used with multiple tools on a tool belt.

SUMMARY OF THE INVENTION

It is an object of the present invention to provide a tool belt mountable retractable tool lanyard. It is another object of the present invention to provide a tool belt mountable device capable of housing multiple retractable tool lanyards.

The present invention achieves these and other objectives by providing a belt mountable tool lanyard device that includes an enclosure with a plurality of parallel chambers for receiving a retractable lanyard component wherein each chamber has an open end through which an end of a retractable lanyard component extends, and a belt loop for mounting on a tool belt.

In one embodiment of the present invention the belt mountable tool lanyard device includes an enclosure having diametrically opposed first and second openings, and a plurality of internal dividers within the enclosure forming a plurality of lanyard device chambers wherein each chamber has at least one chamber opening that faces the same direction as one of the first and second openings and wherein at least one of the plurality of chambers has a second chamber opening diametrically opposed to the one chamber opening forming a belt receiving loop.

In another embodiment of the present invention, the belt mountable tool lanyard device includes a clip receiving member connected to a side of one of the plurality of internal dividers. In one embodiment of the clip receiving member, the clip receiving member is a strip connected at first and second strip ends to the side of one of the plurality of internal dividers.

In another embodiment of the present invention, the lanyard device includes a releasable tool connector attached to the enclosure. In one embodiment, the releasable tool connector is attached to a side seam of the enclosure.

In another embodiment of the present invention, the lanyard device includes a retractable tool lanyard disposed within one of the plurality of lanyard chambers.

In a further embodiment of the present invention, each of the plurality of lanyard chambers having at least one open chamber end has a diametrically opposed chamber end that is openable. In one embodiment, the openable end has a releasable fastener.

In another embodiment of the present invention, the belt mountable tool lanyard device includes a first open-ended lanyard pocket having a first belt clip receiving member attached to an inside surface of the first lanyard pocket, a second open-ended lanyard pocket layered onto the first lanyard pocket having a second belt clip receiving member attached to an inside surface of the second lanyard pocket, and a belt loop layered onto the second retractable tool lanyard pocket wherein the belt loop is sized to receive a tool belt therethrough for attaching the belt mountable tool lanyard device to a tool belt. Because a belt loop is used, the belt mountable tool lanyard device can be slidably positioned to a location on the tool belt preferred by a user. First belt clip receiving member forms a loop for receiving a belt clip of a retractable tool lanyard. Second belt clip receiving member also forms a loop for receiving a belt clip of a retractable tool lanyard.

In another embodiment of the tool lanyard device there is included a first retractable tool lanyard having a belt clip connected to the first belt clip receiving member of the first lanyard pocket where a retractable end of the first retractable tool lanyard extends out one of the open ends of the first lanyard pocket.

In still another embodiment of the tool lanyard device there is included a second retractable tool lanyard having a belt clip connected to the second belt clip receiving member of the second lanyard pocket where a retractable end of the second retractable tool lanyard extends out an open end of the second lanyard pocket located 180° from the open end of the first lanyard pocket containing the retractable end of the first retractable tool lanyard.

The belt mountable tool lanyard device may optionally include a fastening mechanism at the open ends of the first and second lanyard pockets to secure the open ends in a partially closed orientation.

DETAILED DESCRIPTION OF THE PREFERRED EMBODIMENT

Figure 1:
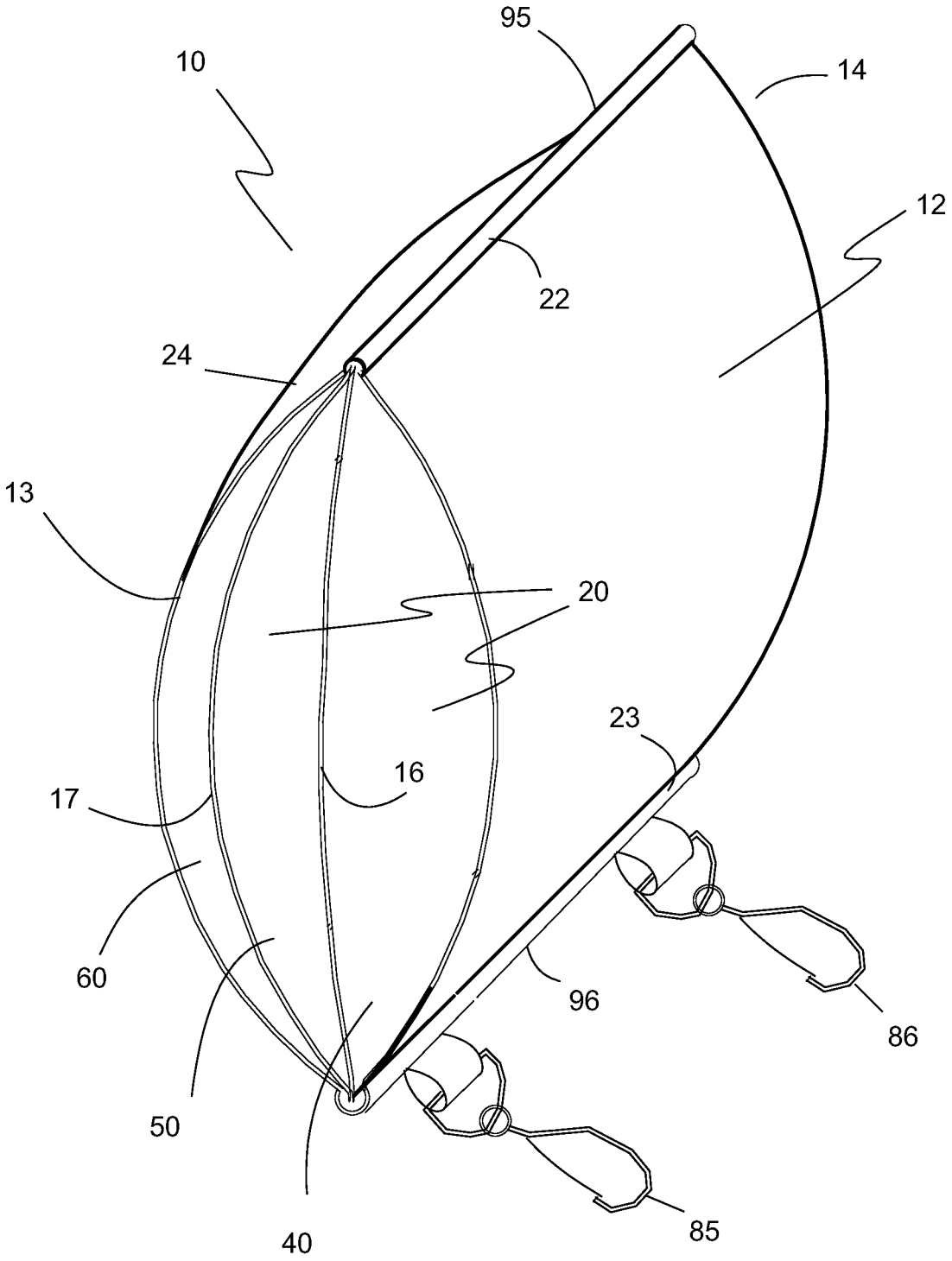
FIG. 1 is a perspective view of one embodiment of the present invention showing a belt mountable tool lanyard device.
Figure 2:
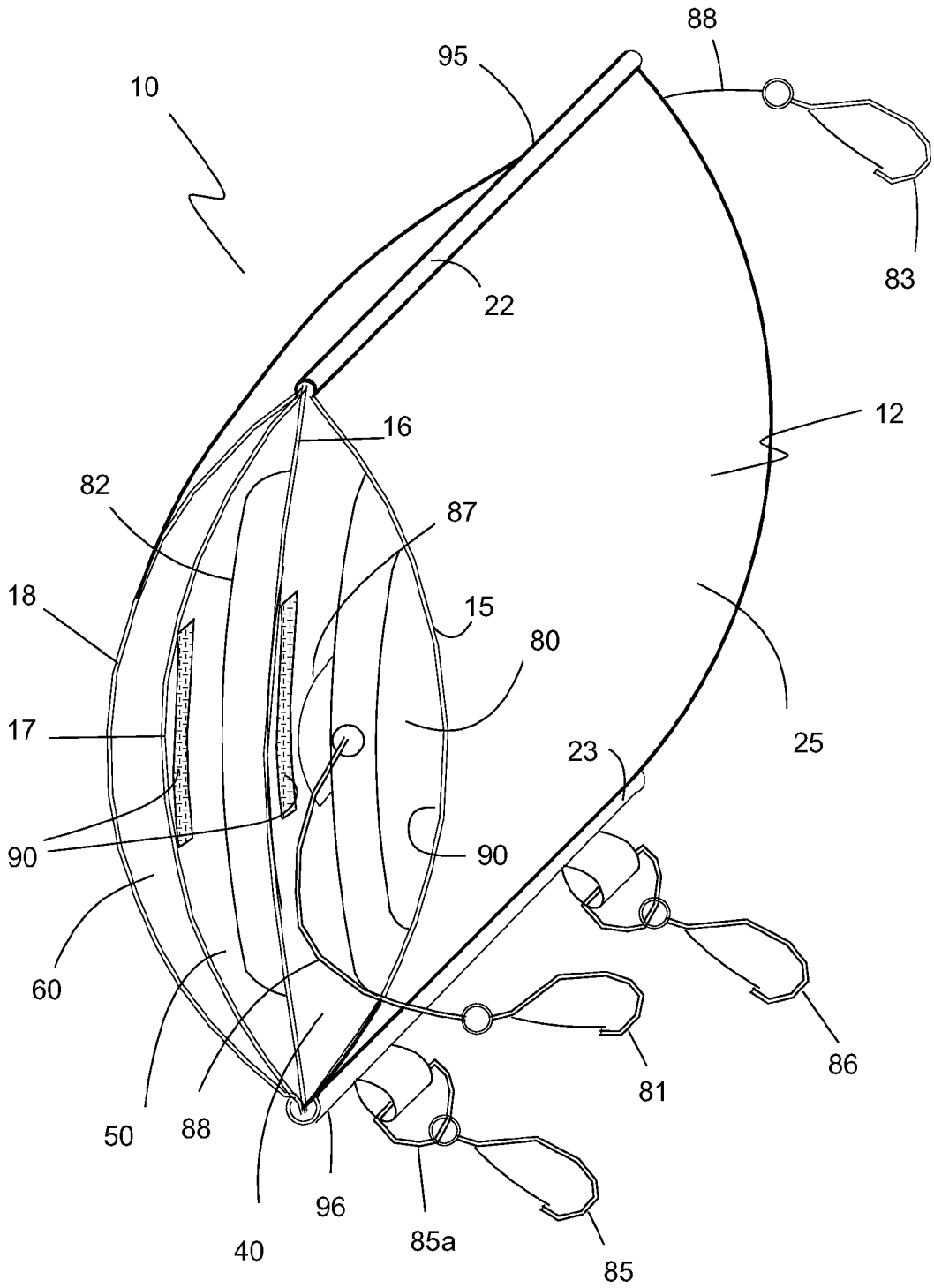
FIG. 2 is a perspective view of one embodiment of the present invention showing a belt mountable tool lanyard device with retractable tool lanyards.
Figure 3:
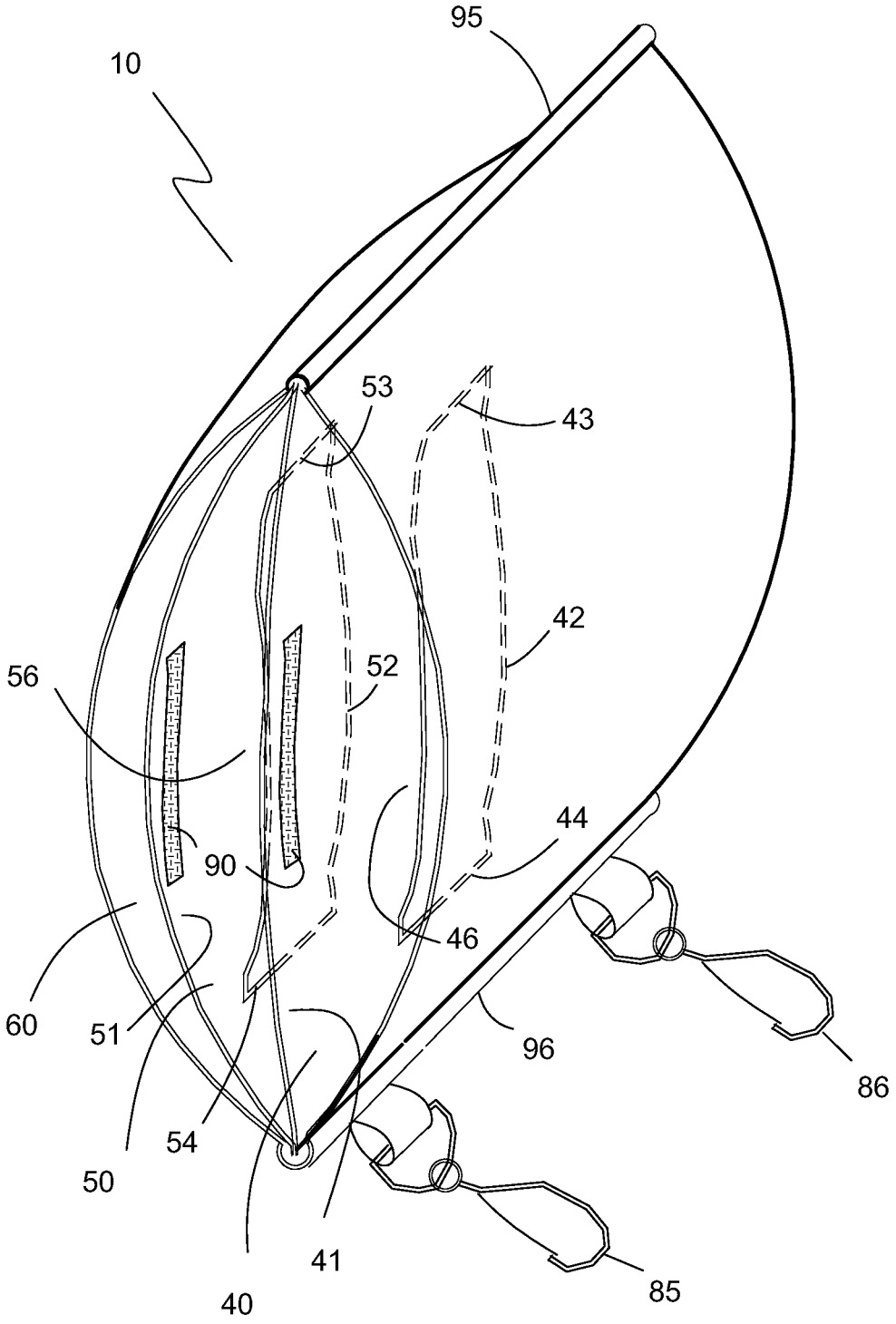
FIG. 3 is a perspective view of the embodiment shown in FIG. 2 but without the retractable tool lanyards.

The preferred embodiment of the present invention is illustrated in FIGS. 1-3. FIG. 1 illustrates one embodiment of a belt mountable tool lanyard device 10 of the present invention. Tool lanyard device 10 has an enclosure 12 with diametrically opposed first and second openings 13, 14, and a plurality of internal dividers 16, 17 forming a plurality of lanyard device chambers or open-ended pockets 19, namely, a first open-ended lanyard pocket 40, a second open-ended lanyard pocket 50 and a belt loop pocket 60. Second open-ended lanyard pocket 50 is layered to first open-ended lanyard pocket 40 and belt loop pocket 60 is layered to second open-ended lanyard pocket 30. Each chamber or pocket 19 has at least one chamber opening 20 that faces in the same direction as one of the first and second openings 13, 14. At least one of the chambers 19 has a second chamber opening 22 (not shown) diametrically opposed to the one chamber opening 20 forming a belt receiving loop 24.

Tool lanyard device 10 may be made of any material typically used for tool belts such as, for example, leather, nylon, polyester, and the like. Preferably, tool lanyard device 10 is made of a flexible material and, more preferably, a flexible and stretchable material. An example of such a material is a stretch nylon fabric. First and second open-ended lanyard pockets 40, 50 receive retractable tool lanyards 80, 82, respectively. Typically, each retractable tool lanyard 80, 82 includes a quick-release tool connector 81 and 83, respectively. Although each of the lanyard pockets 40, 50 and belt loop pocket 60 can be individually made and then layered to each other and connected along parallel side edges forming seams 22, 23 by way of stitching, adhesives, fasteners, and the like.

Turning now to FIG. 2, preferably, tool lanyard device 10 has four layered members 15, 16, 17 and 18 that are attached along a top edge or side seam 95 and a bottom edge or side seam 96 preferably by stitching. Optionally, each open end of first and second lanyard pockets 40, 50 may include a fastener mechanism 90 such as, for example, buttons, snaps, zippers, tabs, hook and loop material, and the like, for closing one or both of the open ends of each pocket 40, 50 to prevent the retractable tools 80, 82 from being inadvertently pushed out of their respective pockets. Preferably, fastener mechanism 90 is a strip of hook and/or loop fastener where the hook fastener is on one inside surface adjacent the open end of each pocket and a mating piece of loop fastener is on an inside surface of the pocket that is opposed to the hook fastener. Tool lanyard device 10 also may optionally include additional quick-release tool connectors 85, 86 for temporary storage of additional tools that do not have a tool pouch on a tool belt. Although quick-release tool connectors 85, 86 are shown coupled to tool lanyard device 10 along bottom edge or side seam 96, it is contemplated that a plurality of quick-release tool connectors 85, 86 may be coupled to top edge or side seam 95 or on outside pocket surface 25.

Turning now to FIG. 3, there is illustrated tool lanyard device 10 without the retractable tool lanyards 80, 82. First lanyard pocket 40 includes a first belt clip receiving member 42. First belt clip receiving member 42 is an elongated member that is attached to an inside surface 41 of first lanyard pocket 40 at or near the clip receiving member ends 43, 44 forming a space 46 between inside surface 41 and clip receiving member 42.

Second lanyard pocket 50 includes a second belt clip receiving member 52. Second belt clip receiving member 52 is also an elongated member that is attached to an inside surface 51 of second lanyard pocket 50 at or near the clip receiving member ends 53, 54 forming a space 56 between inside surface 51 and clip receiving member 52. Clip receiving members 42, 52 are preferably each a strip of material similar to the material used to make tool lanyard device 10. It is noted, however, that clip receiving members 42, 52 may be made of a flexible material, a resilient material, a stretchable material or a rigid material so long as there is a space created between the clip receiving members 42, 52 and the surface 41, 51 upon which their respective ends 43, 44 and 43, 54 are coupled.

First lanyard pocket 40 houses one retractable tool lanyard 80 that attaches to first belt clip retaining member 42, which is preferably sewn to one side of layered member 16 that forms first lanyard pocket 40 with layered member 15. Second lanyard pocket 50 houses another retractable tool lanyard 82 that attaches to second belt clip retaining member 52, which is preferably attached to one side of layered member 17 that forms second lanyard pocket 50 with layered member 16. Note that first and second retractable tool lanyards 80, 82 contain a belt clip 87 (best seen in FIG. 2) that is used to secure the retractable tool lanyards 80, 82 by installing belt clip 87 through the loops 46, 56 formed by belt clip retaining members 42, 52, respectively.

As is shown in FIG. 2, the retractable tool lanyards 80, 82 are positioned within tool lanyard pockets 40, 50, respectively, such that the quick-release tool connectors 81, 83 are rotated 180 degrees relative to each other allowing for tool pouches to be placed on both sides of tool lanyard device 10. It is contemplated that tool lanyard device 10 may include additional tool lanyard pockets containing retractable tool lanyards whose orientation alternates from side to side (i.e. 180° rotation) relative to the quick-release tool connectors of the retractable tool lanyards.

Figure 4:
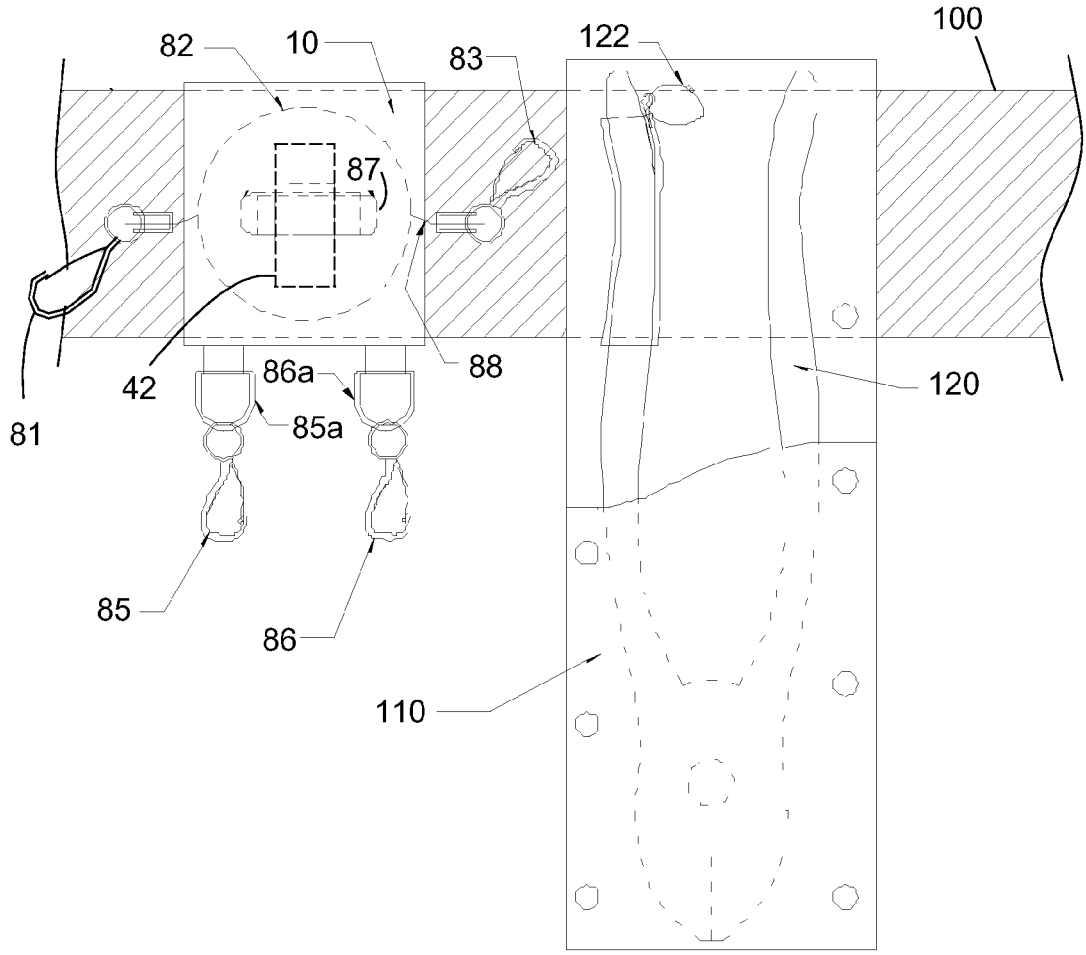
FIG. 4 is a front plan view of the embodiment shown in FIG. 1 mounted on a tool belt.

FIG. 4 shows the tool lanyard device 10 attached to a portion of a tool belt 100. Typically, a tool belt 100 will have a tool pouch 110 that contains a tool 120 such as, for example, a pair of pliers. Tool lanyard device 10 is preferably positioned adjacent tool pouch 110 so that quick-release tool connector 83 can be easily attached to a lanyard loop 122 attached to tool 120.

When existing tool pouches are not being used or when just one tool pouch is being used, then quick-release tool connectors 85, 86, which are typically attached to a D-ring 85*a*, 86*a*, respectively, can be used to house tools with similar attachment means as used on tool 120. When a tool hanging from one of the tool connectors 85, 86 is ready to be used, it is detached from its quick-release tool connector and then connected to one of tool connectors 81 or 83 on the retractable tool lanyard 80, 82, respectively.

To install the tool lanyard device 10, tool belt 100 is inserted into belt loop 60 and tool lanyard device 10 is slidingly moved to its desired position. Typically, tool lanyard device 10 will be installed adjacent to tool pouch 110. To optimize the use of tool lanyard device 10, a second tool pouch similar to tool pouch 110 can be installed on the opposite side of tool lanyard device 10.

Once installed, tool connector 83 can now be connected to lanyard loop 122 installed on the tool 120 housed in tool pouch 110. As an alternative to lanyard loop 122, mechanically attached D-rings, split rings or other similar attachment means can be installed on the tools housed in tool pouch 110 making the tool adaptable to the retractable tool lanyard device 10. Once quick-release tool connector 83 is connected to tool loop 122, the tool 120 can now be used. Once tool 120 is pulled from tool pouch 110, retractor tool lanyard 82 will release the cable 88 so that tool 120 can be used.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A belt mountable tool lanyard device comprising:

an enclosure having diametrically opposed first and second openings; and a plurality of internal dividers within the enclosure forming a plurality of lanyard device chambers wherein each chamber has diametrically opposed chamber openings that only face in the same direction as the first and second openings of the enclosure, wherein at least one of the plurality of chambers forms a belt receiving loop, and wherein all of the plurality of internal dividers have opposed divider edges that are permanently joined together along opposed divider edges wherein one of the plurality of opposed divider edges forms a top side seam of the enclosure and wherein the other of the plurality of opposed divider edges forms a bottom side seam of the enclosure.

2. The device of claim 1 further comprising a clip receiving member directly connected to a side of one of the plurality of internal dividers forming a space between the clip receiving member and the side of one of the plurality of internal dividers wherein the space having first and second openings faces in the same direction as the first and second openings of the enclosure.

3. The device of claim 2 wherein the clip receiving member is a strip connected at first and second strip ends to the side of one of the plurality of internal dividers.

4. The device of claim 1 further comprising a releasable tool connector attached to the enclosure.

5. The device of claim 4 wherein the releasable tool connector is attached to a side seam of the enclosure.

6. The device of claim 1 further comprising a retractable tool lanyard disposed within one of the plurality of lanyard chambers.

7. The device of claim 1 wherein each of the plurality of lanyard chambers having at least one open chamber end has a diametrically opposed chamber end that is openable.

8. The device of claim 7 wherein the openable end has a releasable fastener.

9. A belt mountable lanyard device comprising:

a first open-ended lanyard pocket having only a pair of opposed first pocket open ends formed by a pair of opposed side seams transverse to the pair of opposed first pocket open ends and a first belt clip receiving member attached to an inside surface of the first lanyard pocket forming a loop for receiving a belt clip of a retractable tool lanyard;

a second open-ended lanyard pocket layered onto the first lanyard pocket and permanently attached with the first lanyard pocket along the pair of opposed side seams with the first lanyard pocket, the second lanyard pocket having a pair of opposed second pocket open ends and a second belt clip receiving member attached to an inside surface of the second lanyard pocket forming a loop for receiving a belt clip of a retractable tool lanyard; and a belt loop layered onto the second retractable tool lanyard pocket and permanently joined along the pair of opposed side seams of the first retractable tool lanyard pocket and the second retractable tool lanyard pocket, the belt loop having only a pair of opposed belt loop open ends wherein the belt loop is sized to receive a tool belt therethrough for attaching the belt mountable tool lanyard device to a tool belt wherein the pair of opposed first lanyard pocket open ends, the pair of opposed second lanyard pocket open ends and the pair of opposed belt loop open ends face in the same direction and wherein one of the pair of opposed side seams forms a top side seam and another of the pair of opposed side seams forms a bottom side seam of the belt mountable lanyard device.

10. The device of claim 9 further comprising a first retractable tool lanyard having a belt clip connected to the first belt clip receiving member of the first lanyard pocket wherein a retractable end of the first retractable tool lanyard extends out one of the pair of opposed first pocket open ends of the first lanyard pocket.

11. The device of claim 9 further comprising a releasable tool connector attached to the side seam of the lanyard device.

12. The device of claim 9 wherein at least one of the pair of opposed first pocket open ends is closable.

13. The device of claim 9 wherein at least one of the pair of opposed second pocket open ends is closable.

* * * * *